US006510669B1

(12) United States Patent
Bellei et al.

(10) Patent No.: US 6,510,669 B1
(45) Date of Patent: Jan. 28, 2003

(54) UNIT FOR STERILIZING STRIP MATERIAL ON A PACKAGING MACHINE FOR PACKAGING POURABLE FOOD PRODUCTS, AND PACKAGING MACHINE COMPRISING SUCH A UNIT

(75) Inventors: Renzo Bellei, Modena (IT); Tiziano Di Fede, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/538,238

(22) Filed: Mar. 30, 2000

(30) Foreign Application Priority Data

May 3, 1999 (EP) ..... 99830264

(51) Int. Cl.[7] ..... B65B 17/00

(52) U.S. Cl. ..... 53/167; 53/265; 53/371.3; 53/425; 493/394; 493/213

(58) Field of Search ..... 53/167, 425, 426, 53/264, 265, 371.4; 422/28, 293, 31; 493/114, 213, 394

(56) References Cited

U.S. PATENT DOCUMENTS

| | | | | | |
|---|---|---|---|---|---|
| 3,947,249 | A | * | 3/1976 | Egger | 53/167 |
| 4,104,024 | A | | 8/1978 | Vogele et al. | 21/58 |
| 4,225,556 | A | | 9/1980 | Löthman et al. | 422/28 |
| 4,296,068 | A | * | 10/1981 | Hoshino | |
| 4,396,582 | A | * | 8/1983 | Kodera | 53/167 |
| 4,987,721 | A | * | 1/1991 | Turtschan | 53/167 |
| 5,173,259 | A | * | 12/1992 | Bordini | 422/28 |
| 5,424,034 | A | | 6/1995 | Hilmersson | 422/28 |
| 5,569,438 | A | | 10/1996 | Hilmersson | 422/293 |
| 6,017,412 | A | * | 1/2000 | Erden et al. | |
| 6,131,369 | A | * | 10/2000 | Ausnit | |
| 6,131,374 | A | * | 10/2000 | Bois | |

FOREIGN PATENT DOCUMENTS

| | | |
|---|---|---|
| DE | 30 28 208 A1 | 2/1982 |
| EP | 0 816 233 A1 | 1/1998 |

* cited by examiner

*Primary Examiner*—Eugene Kim
*Assistant Examiner*—Sameh Tawfik
(74) *Attorney, Agent, or Firm*—Burns, Doane, Swecker & Mathis, L.L.P.

(57) ABSTRACT

A unit (3) for sterilizing strip packaging material (2) with preapplied opening devices (5) on a packaging machine (1) for packaging pourable food products, the unit (3) having a bath (8) for containing a sterilizing agent in which the material (2) is fed continuously, and an aseptic chamber (15) having an input (12) connected to an output of the bath (8); the aseptic chamber (15) houses two drying rollers (20) cooperating with opposite faces of the material (2) and having respective recesses (20*a*) at a longitudinal portion (2*a*) of the material (2) fitted with the opening devices (5), and two nozzles (27) for directing sterile air onto the longitudinal portion (2*a*) of the material (2).

7 Claims, 4 Drawing Sheets

UNIT FOR STERILIZING STRIP MATERIAL ON A PACKAGING MACHINE FOR PACKAGING POURABLE FOOD PRODUCTS, AND PACKAGING MACHINE COMPRISING SUCH A UNIT

FIELD OF THE INVENTION

The present invention relates to a unit for sterilizing strip material on a packaging machine for packaging pourable food products, and to a packaging machine comprising such a unit.

BACKGROUND OF THE INVENTION

Machines for packaging pourable food products, such as fruit juice, wine, tomato sauce, pasteurized or long-storage (UHT) milk, etc., are known in which packages are formed from a continuous tube of packaging material defined by a longitudinally sealed strip.

The packaging material has a multilayer structure comprising a layer of paper material covered on both sides with layers of heat-seal material, e.g. polyethylene. In the case of aseptic packages for long-storage products such as UHT milk, the packaging material comprises a layer of barrier material defined, for example, by an aluminium film, which is superimposed on a layer of heat-seal plastic material and is in turn covered with another layer of heat-seal plastic material which eventually defines the inner face of the package contacting the food product.

For producing aseptic packages, the strip of packaging material is unwound off a reel and fed through a sterilizing unit in which it is sterilized, for example, by immersion in a bath of liquid sterilizing agent such as a concentrated solution of hydrogen peroxide and water.

More specifically, the sterilizing unit comprises a bath filled, in use, with the sterilizing agent in which the strip is fed continuously. The bath conveniently comprises two parallel vertical branches connected at the bottom to define a U-shaped path of a length depending on the traveling speed of the strip and such as to allow enough time to treat the packaging material. For effective, fairly fast treatment, so as to reduce the size of the sterilizing chamber, the sterilizing agent must be maintained at a high temperature of, say, roughly 70° C.

The sterilizing unit also comprises an aseptic chamber in which the strip of packaging material issuing from the sterilizing bath is treated to remove any residual sterilizing agent. The amount of residual sterilizing agent allowed in the packaged product, in fact, is governed by strict standards (the maximum permissible amount being in the order of a few parts per million).

The above treatment normally comprises a preliminary operation to mechanically remove any drops on the material, and which is normally performed by means of two cylindrical drying rollers conveniently located close to the input of the aseptic chamber, and between which the material is fed., Downstream from the rollers, the material is still wet but with no macroscopic drops, and is fed between two air knives by which any residual traces of sterilizing agent are evaporated.

Before leaving the aseptic chamber, the strip is folded into a cylinder and sealed longitudinally to form in known manner a continuous, vertical, longitudinally sealed tube. The tube of packaging material, in fact, forms an extension of the aseptic chamber and is filled continuously with the pourable product and then fed to a forming and (transverse) sealing unit for forming individual packages and by which the tube is gripped between pairs of jaws to seal the tube transversely and form aseptic pillow packs.

The pillow packs are separated by cutting the sealed portions between the packs, and are then fed to a final folding station where they are folded mechanically into the finished form.

Packaging machines of the above type are used widely and satisfactorily in a wide range of food industries to form aseptic packages from continuous flat strip material; and performance of the sterilizing unit, in particular, is such as to amply conform with standards governing asepticity of the packages and residual sterilizing agent.

Within the industry, however, demand for further improvement exists, especially as regards elimination of residual sterilizing agent, and which stems, in particular, from market demand for packages featuring reclosable opening devices which are easy to open and provide for easy pouring of the product.

In the case of nonaseptic packaging machines, such devices are applied, e.g. injection molded directly, to the strip material before the packages are formed.

Conversely, in the case of aseptic packaging machines, any opening devices are normally applied after the packages are formed. That is, if applied beforehand to the strip, the opening devices form breaks in the geometric continuity of the strip, in which residual sterilizing agent may become trapped, and from which the sterilizing agent cannot be removed completely using known techniques. In particular, the opening devices project from the packaging material and prevent use of the aforementioned known drying rollers.

Applying the opening devices to the finished packages poses drawbacks from the production standpoint by requiring complex, high-cost systems for supplying and applying the devices.

It is an object of the present invention to provide a unit for sterilizing strip material, in particular on a machine for packaging pourable food products, designed to solve the aforementioned problems, and which in particular provides for forming aseptic packages from strip packaging material to which opening devices are applied beforehand.

SUMMARY OF THE INVENTION

According to the present invention, there is provided a unit for sterilizing strip packaging material on a packaging machine for packaging pourable food products, the unit comprising a bath for containing a sterilizing agent in which the packaging material is fed continuously; and an aseptic chamber having an input connected to an output of said bath and housing two drying rollers cooperating with opposite faces of said packaging material; characterized in that said rollers have respective recesses at a longitudinal portion of said packaging material having a succession of preapplied opening devices; said unit comprising auxiliary means for removing residual sterilizing agent from said longitudinal portion of said packaging material.

By virtue of the recesses on the drying rollers, the drying rollers may also be used on packaging material with preapplied opening devices; and the combined action of the drying rollers and the auxiliary means for sterilizing the portion of the material to which the opening devices are applied, and which is unaffected by the drying rollers, provides for removing all the sterilizing agent from the material.

In a preferred embodiment, the auxiliary means are defined by two nozzles supplied with sterile air.

The sterile air supplied to the nozzles is preferably drawn from the aseptic chamber by means of a recirculating circuit.

The present invention also relates to a packaging machine for producing packages of pourable food products from strip packaging material, the machine comprising a sterilizing unit for sterilizing said packaging material and in turn comprising a bath for containing a sterilizing agent in which the packaging material is fed continuously, and an aseptic chamber having an input connected to an output of said bath and housing two drying rollers cooperating with opposite faces of said packaging material; and applying means for applying opening devices for said packages; characterized in that said applying means are located upstream from said sterilizing unit to apply said opening devices successively to a longitudinal portion of said packaging material; and in that said rollers have respective recesses at said longitudinal portion of said packaging material; said sterilizing unit comprising auxiliary means for removing residual sterilizing agent from said longitudinal portion of. said packaging material.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
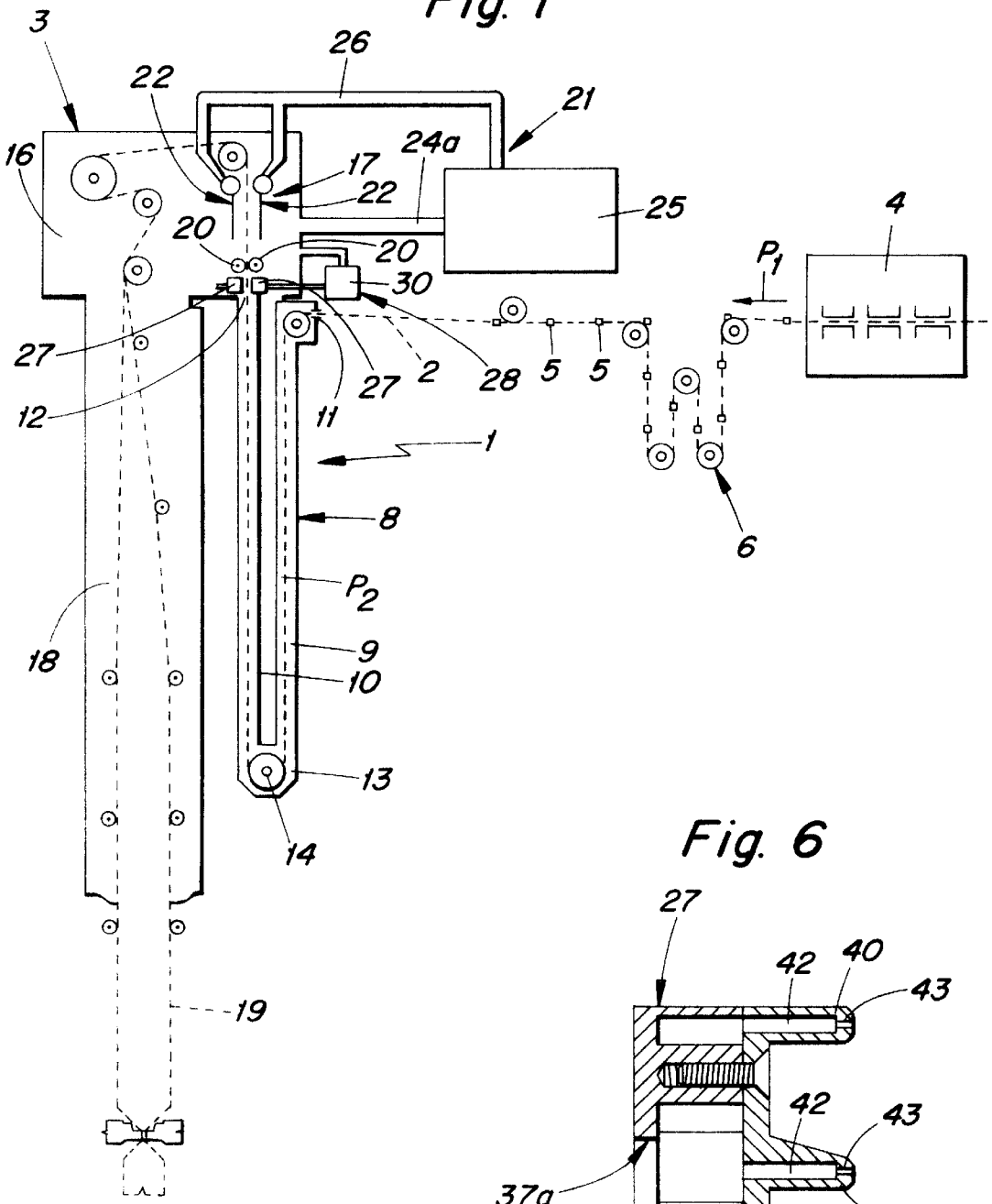
FIG. 1 shows a diagram of a machine for packaging pourable-e food products and featuring a sterilizing unit in accordance with the invention.

Number 1 in FIG. 1 indicates as a whole a machine for packaging pourable food products and for continuously forming aseptic packages of a pourable food product from a strip packaging material 2 (hereinafter referred to simply as "strip 2" for the sake of simplicity).

Machine 1 comprises a sterilizing unit 3 for sterilizing strip 2, and to which strip 2 is fed off a reel (not shown) along a substantially horizontal path P1.

Machine 1 also comprises an application unit 4 for applying reclosable opening devices 5 to strip 2 and located upstream from the sterilizing unit. Application unit 4 is conveniently defined by a known station for injection molding plastic material, and through which strip 2 is fed in steps. At the output of unit 4, the strip comprises a succession of opening devices 5 equally spaced along an intermediate longitudinal portion 2*a* of the strip (and only shown schematically in FIG. 1 along a limited portion of strip 2). At the output of application unit 4 and upstream from sterilizing unit 3, a strip store 6 is conveniently provided to compensate for the different strip feeds of the two units (step feed and continuous feed respectively).

Sterilizing unit 3 substantially comprises a U-shaped sterilizing bath 8 for containing a liquid sterilizing agent, e.g. a 30% solution of hydrogen peroxide ($H_2O_2$) and water, up to a predetermined level. Bath 8 is defined by a vertical input branch 9 and a vertical output branch 10 having respective top openings 11 and 12 respectively defining the input and output of strip 2 to and from bath 8; and the two branches are connected at the bottom by a bottom portion 13 of bath 8 housing a horizontal-axis guide roller 14.

Inside bath 8, strip 2 is therefore fed along a U-shaped path P2, the length of which depends on the traveling speed of the strip and is such as to ensure the packaging material remains a sufficient length of time (e.g. 7 seconds) inside the sterilizing agent.

Bath 8 forms part of a known peroxide control circuit (not shown), and is maintained, in use, at a controlled temperature, e.g. of about 70° C.

Machine 1 also comprises an aseptic chamber 15 having an input opening 12 coincident with the output of bath 8. Aseptic chamber 15 comprises a top portion 16 housing drying means indicated as a whole by 17 and for removing residual sterilizing agent from strip 2; and a bottom portion or tower 18 extending vertically and parallel to bath 8, and in which strip 2 is folded longitudinally into a cylinder and sealed longitudinally to form a continuous cylindrical tube 19.

Drying means 17 comprise two idle drying rollers 20 which are covered with relatively soft material, have respective horizontal axes parallel to each other, are located close to the input of aseptic chamber 15, on opposite sides of strip 2, and press against opposite faces of strip 2 to remove any drops of sterilizing agent which therefore fall back into bath 8.

Figure 2:
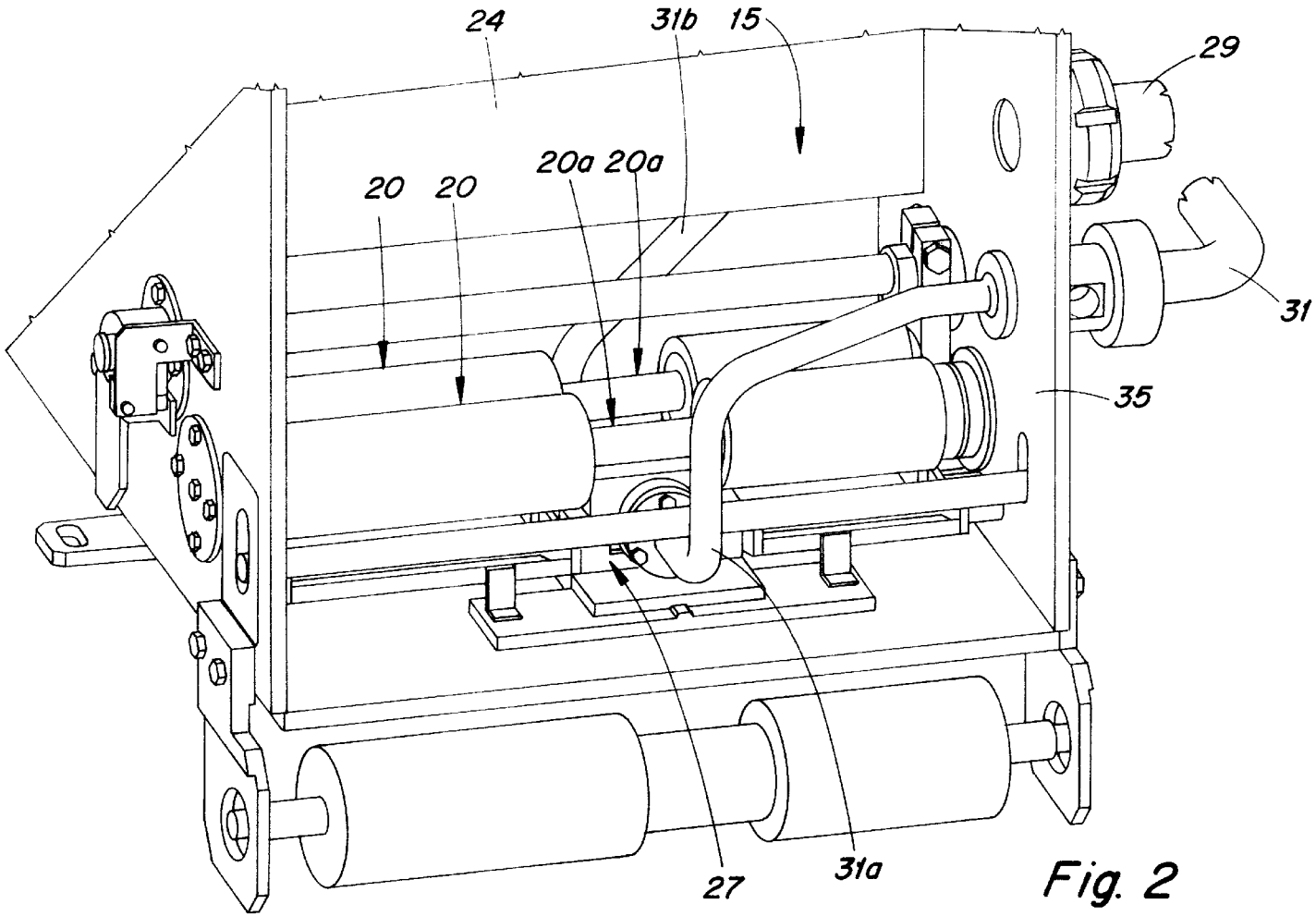
FIGS. 2 and 3 show, respectively, a partial view in perspective and a partial front view of the sterilizing unit according to the invention.
Figure 3:
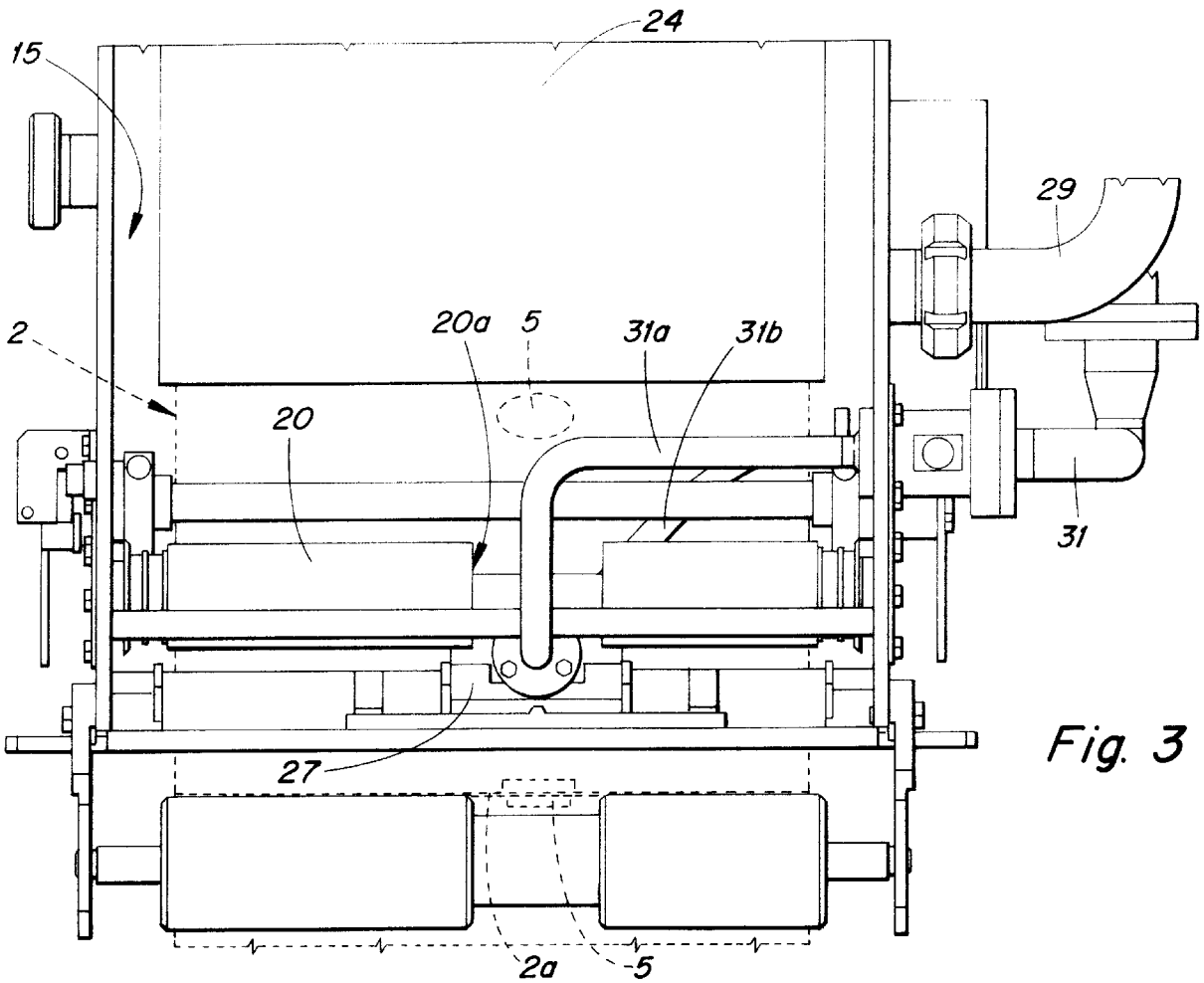

Rollers 20 (FIGS. 2 and 3) conveniently comprise respective intermediate recesses 20*a* located at intermediate longitudinal portion 2*a* of strip 2 to permit the passage of opening devices 5 without interfering with the rollers (FIG. 3). In the example shown, recesses 20*a* are defined by respective smaller-diameter intermediate portions of rollers 20.

Figure 4:
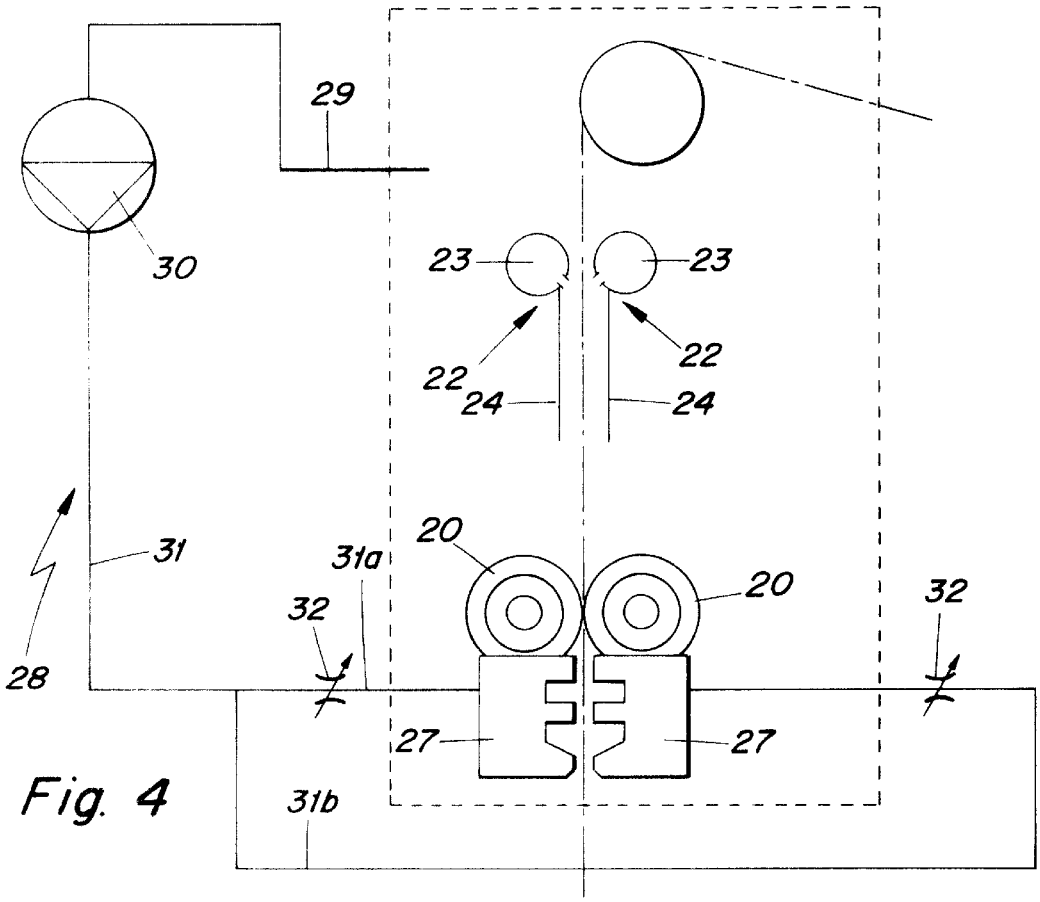
FIG. 4 shows a diagram of an auxiliary air-recirculating circuit of the FIG. 2 unit.

Drying means 17 also comprise two air knives 22 located on opposite sides of strip 2, downstream from (in the strip feed direction) and therefore over rollers 20. Air knives; 22, which are known and only shown schematically in FIG. 4, each comprise a nozzle 23 for directing a jet of air downwards onto strip 2; and a respective wall 24 for guiding the jet, in use, in a direction substantially parallel to the strip but opposite to the traveling direction of the strip.

Nozzles 23 form part of a known main air circuit 21 (not described in detail) comprising an intake conduit 24*a* from aseptic chamber 15; a processing unit 25 having suction means, means for removing residual sterilizing agent, and heating means; and a conduit 26 for supplying nozzles 23.

Aseptic chamber 15 is maintained slightly above ambient pressure, so that any leakage through the seals occurs outwards as opposed to inwards of the chamber. The overpressure, however, must be limited, in the region of a few mbars, to prevent an excessive amount of air contaminated with the sterilizing agent from leaking and so contaminating the working environment.

According to the present invention, drying means 17 also comprise two nozzles 27 located at the input of aseptic chamber 15, on opposite sides of strip 2, immediately upstream from rollers 20 and at recesses 20*a* of rollers 20.

Nozzles 27 provide for directing a stream of air onto intermediate longitudinal portion 2*a* of strip 2, at opening devices 5, to remove any residual sterilizing agent from the opening devices. Nozzles 27 form part of an auxiliary sterile-air recirculating circuit 28 shown in FIG. 4 and partly in FIGS. 2 and 3.

Circuit 28 substantially comprises an intake conduit 29 for withdrawing sterile air from aseptic chamber 15; a blower 30 (FIG. 4) having a suction port connected to conduit 29; and a delivery conduit 31 connected to a delivery port of blower 30. Delivery conduit 31 divides into two supply conduits 31*a*, 31*b* connected to respective nozzles 27 and conveniently comprising respective variable resisters 32 for regulating flow to respective nozzles 27.

Blower 30 is conveniently a so-called "side-channel" or "air-ring" type, e.g. of the type marketed by the name of Flux-Jet by ESAM S.p.A., which is entirely dry-operated (i.e. with no lubricant) to avoid contaminating the sterile air. The above type of blower is also characterized by producing a slight depression on the suction side, and gradually increasing pressure up to the delivery side, so that, in view of the fact that suction occurs at aseptic chamber pressure (slightly above ambient pressure), the air in blower 30 is only slightly below ambient pressure on the suction side where static seals may easily be provided, and elsewhere along its path is above ambient pressure to safely keep out any contaminants.

FIGS. 2 and 3 show conduit 29 for withdrawing sterile air from aseptic chamber 15; delivery conduit 31; and conduits 31*a*, 31*b* for supplying nozzles 27. Blower 30 (not shown) is conveniently fitted to a lateral wall 35 of aseptic chamber 15.

Figure 6:
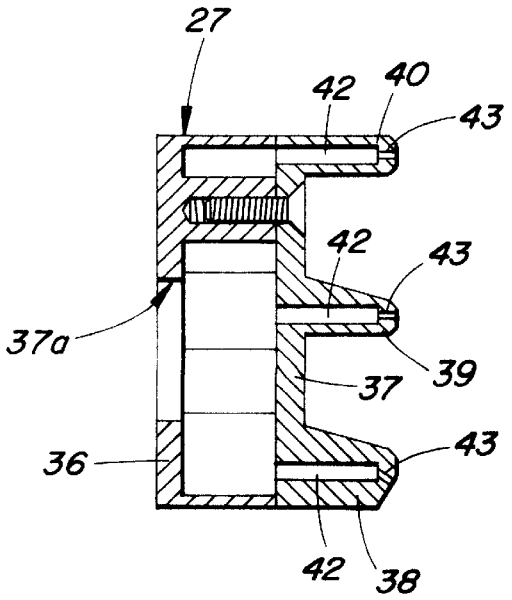
FIG. 6 shows a section along line VI—VI in FIG. 5.
Figure 5:
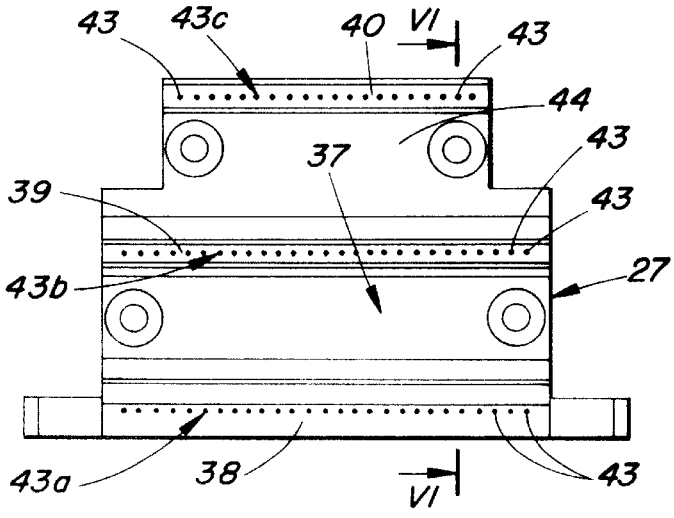
FIG. 5 shows a front view of a nozzle on the FIG. 2 unit.

FIGS. 5 and 6 show one of nozzles 27, and, as both nozzles are identical, the following description applies to both.

Nozzle 27 substantially comprises a hollow box-shaped body 36 having a rear opening 37*a* for receiving a fitting (not shown) for respective supply conduit 31*a* or 31*b*; body 36 is closed at the front by a shaped plate 37 having a number of (e.g. three) parallel horizontal projections 38, 39, 40; and each projection 38, 39, 40 has a longitudinal inner cavity 42 (FIG. 6) communicating with the cavity of body 36, and a respective row 43*a*, 43*b*, 43*c* of equally spaced ejector holes 43, each communicating with respective cavity 42.

The holes 43 in bottom projection 38 have respective downward-sloping axes to direct a jet of air onto strip 2 in such a direction as to blow any residual sterilizing agent removed from strip 2, and in particular from opening devices 5, back into bath 8; and holes 43 in intermediate projection 39 and top projection 40 have respective horizontal axes to direct a jet of air onto strip 2 in a direction substantially perpendicular to the strip.

Nozzle 27 has a narrow top portion 44 and therefore a narrower top projection 40 with fewer holes 43 as compared with the other projections, so as to enable nozzle 27 to be located close to a respective roller 20, with top portion 44 substantially housed inside recess 20*a* of the respective roller.

Tests have shown the above arrangement of holes 43 to be particularly effective in removing residual sterilizing agent from opening devices 5. In particular, the arrangement of holes 43 on projections 38, 39, 40 enables the air issuing from the holes to be disposed of laterally through the gaps defined between the projections and strip 2, thus preventing stagnation or turbulence which would impair effective removal of residual sterilizing agent.

In actual use, strip 2 is fed in steps through application unit 4 where opening devices 5 are formed, and continuously through bath 8 and aseptic chamber 15.

On entering aseptic chamber 15, portion 2*a* of strip 2 with preapplied opening devices 5 is swept on both faces by the air jets from nozzles 27. The first row of holes 43 blows a certain amount of residue back into bath 8; and the next two rows of holes 43 break the drops of sterilizing agent down into small particles to assist removal and evaporation. It should be pointed out that the temperature of the air jets from nozzles 27 is slightly higher than that of aseptic chamber 15, roughly about 80° C. : this is due to the fall in temperature of the air aspirated by blower 30 and traveling along conduits 29 and 31 being more than compensated by the increase in temperature as the air is compressed in blower 30.

Strip 2 is then fed between rollers 20 which substantially remove any macroscopic traces of liquid from the lateral portions of strip 2 unaffected by nozzles 27. The drops of sterilizing agent removed at this stage tend to drop back into bath 8.

Downstream from rollers 20, strip 2, by now devoid of droplets, is swept, in the opposite direction to its own traveling direction, by the jets generated by air knives 22; the residual liquid is thus removed completely and strip 2, now perfectly dry, is folded into a tube, sealed longitudinally, filled and formed/sealed transversely into packages.

Clearly, changes may be made to machine 1, and in particular to sterilizing unit 3, without, however, departing from the scope of the accompanying Claims.

For example, recesses 20*a* of rollers 20 may be defined by any appropriate discontinuity of the rollers; in particular, each roller 20 may be replaced by two coaxial, axially-spaced rollers.

Moreover, the auxiliary means for removing residual sterilizing agent from the intermediate longitudinal portion of the packaging material may be of any type, e.g. ultrasonic. In the event the auxiliary means are defined by nozzles, changes may be made to the number, form and arrangement of the nozzles.

Finally, unit 4 for applying opening devices 5 may be of any type, and in particular may provide for applying pre-formed opening devices to strip 2 as opposed to molding the devices directly onto the strip.

What is claimed is:

1. A packaging machine for producing packages of pourable food products from strip packaging material, the machine comprising a sterilizing unit for sterilizing said packaging material and in turn comprising a bath for containing a sterilizing agent in which the packaging material is fed continuously, and an aseptic chamber having an input connected to an output of said bath and housing two drying rollers cooperating with opposite faces of said packaging material; and applying means for applying opening devices for said packages; wherein said applying means are located upstream from said sterilizing unit to apply said opening devices successively to a longitudinal portion of said packaging material; and in that said drying rollers have respective recesses, the recesses being configured to allow passage of the opening devices without interference from the rollers at said longitudinal portion of said packaging material; said sterilizing unit comprising auxiliary means for removing residual sterilizing agent disposed on the opening devices on said longitudinal portion of said packaging material.

2. A machine as claimed in claim 1, characterized in that said auxiliary means for removing residual sterilizing agent comprise two nozzles located on opposite sides of said packaging material, facing said longitudinal portion where the opening devices are applied, adjacent said input of said aseptic chamber and immediately upstream from said drying rollers.

3. A machine as claimed in claim 2, characterized by comprising an auxiliary recirculating circuit in turn comprising suction means for-aspirating sterile air from said aseptic chamber, and supply means for supplying said nozzles and connected to said suction means.

4. A machine as claimed in claim 2, characterized in that said applying means for applying said opening devices comprise an injection molding unit for injection molding plastic material.

5. A packaging machine for producing packages of pourable food products from strip packaging material, the machine comprising a sterilizing unit for sterilizing said packaging material and in turn comprising a bath for containing a sterilizing agent in which the packaging material is fed continuously, and an aseptic chamber having an input connected to an output of said bath and housing two drying rollers cooperating with opposite faces of said packaging material; and applying means for applying opening devices for said packages; the applying means being located upstream from said sterilizing unit to apply said opening devices successively to a longitudinal portion of said packaging material; and in that said drying rollers have respective recesses, the recesses being configured to allow passage of the opening devices without interference from the rollers at said longitudinal portion of said packaging material; said sterilizing unit comprising auxiliary means for removing residual sterilizing agent from said longitudinal portion of said packaging material, the auxiliary means including two nozzles located on opposite sides of said packaging material, facing said longitudinal portion where opening devices are applied, adjacent said input of said aseptic chamber and immediately upstream from said drying rollers wherein said nozzles each comprise a number of ejection holes arranged in a number of horizontal rows formed on spaced respective front projections of each of said nozzles.

6. A unit as claimed in claim 5, characterized in that said bath defines a U-shaped path for said packaging material, and has a top output coincident with said input of said aseptic chamber; and in that the holes in at least one of said rows, adjacent to said input of said aseptic chamber, are inclined towards said bath; the holes in the other rows being substantially perpendicular to said packaging material.

7. A machine as claimed in claim 6, characterized in that said nozzles have respective narrow top portions at least partly housed inside the respective said recesses of said drying rollers.

* * * * *